US005457894A

United States Patent [19]

Dorber

[11] Patent Number: 5,457,894

[45] Date of Patent: Oct. 17, 1995

[54] IMPLEMENT FOR STYLING/DRYING HAIR FOR AN AIR-MOVING APPLIANCE FOR PERSONAL USE

[75] Inventor: Ralf Dorber, Schmitten, Germany

[73] Assignee: Braun Aktiengessellschaft, Kronberg, Germany

[21] Appl. No.: 232,241

[22] PCT Filed: Nov. 4, 1993

[86] PCT No.: PCT/EP93/03082

§ 371 Date: Aug. 8, 1994

§ 102(e) Date: Aug. 8, 1994

[87] PCT Pub. No.: WO94/14354

PCT Pub. Date: Jul. 7, 1994

[30] Foreign Application Priority Data

Dec. 22, 1992 [DE] Germany ..... 42 43 640.0

[51] Int. Cl.[6] ..... A45D 20/00

[52] U.S. Cl. ..... 34/98; 34/101; 392/384; 392/380

[58] Field of Search ..... 34/96, 97, 98, 34/101; 392/380, 381, 382, 383, 384; 132/115, 271

[56] References Cited

U.S. PATENT DOCUMENTS

| | | | |
|---|---|---|---|
| D. 354,152 | 1/1995 | Mathews | D28/18 |
| 4,295,283 | 10/1981 | Tomaro | 34/97 |
| 5,060,398 | 10/1991 | Wolens | 34/97 |
| 5,212,366 | 5/1993 | McDougall | 34/97 |
| 5,275,339 | 1/1994 | Andis et al. | 34/98 |

FOREIGN PATENT DOCUMENTS

| | | | |
|---|---|---|---|
| 4100398A1 | 1/1991 | Germany . | |
| 9100180 U | 6/1992 | Germany . | |
| 4100398 | 7/1992 | Germany . | |
| 2230184 | 10/1990 | United Kingdom | 20/52 |
| WO89/09554 | 10/1989 | WIPO . | |

OTHER PUBLICATIONS

Product literature for Babyliss "Volum'Air" hair appliance, 3 pages (undated).

Use instructions for EWT (Elektro–Wärme–Technik Company) "Soft dryer" Model SD 5043, undated.

Package box panels of EWT (Elektro–Wärme–Technik Company) "Soft Dryer 1400W, Model SD 5043 Set", undated.

Photograph of EWT (Elektro–Wärme–Technik Company) Model SD 5043 "Comb attachmet".

Use Instructions for Toshiba hair appliance HDL–B730, HDL–B731, HDL–B732, covers and pp. 1–8, undated (Japanese language).

Boots Christmas Gift Guide 1991 (p. 3) showing "Babyliss Lightweight Professional Dryer and Diffuser".

Three Views from an Engineering Drawing of a Diffuser, latest revision dated May 3, 1990.

*Primary Examiner*—Denise L. Gromada
*Assistant Examiner*—Susanne C. Tinker
*Attorney, Agent, or Firm*—Edward S. Podszus

[57] ABSTRACT

The invention is directed to an implement for an air-moving appliance for personal use, in particular a hair dryer or a hot-air curling brush, comprising a body (10) and a two-dimensional air discharge means (12) which includes a series of air exit apertures (14) and carries a series of hair pickup elements (16) arranged adjacent to each other. Downward ends (18) of the hair pickup elements (16) lie on a substantially concave surface.

83 Claims, 3 Drawing Sheets

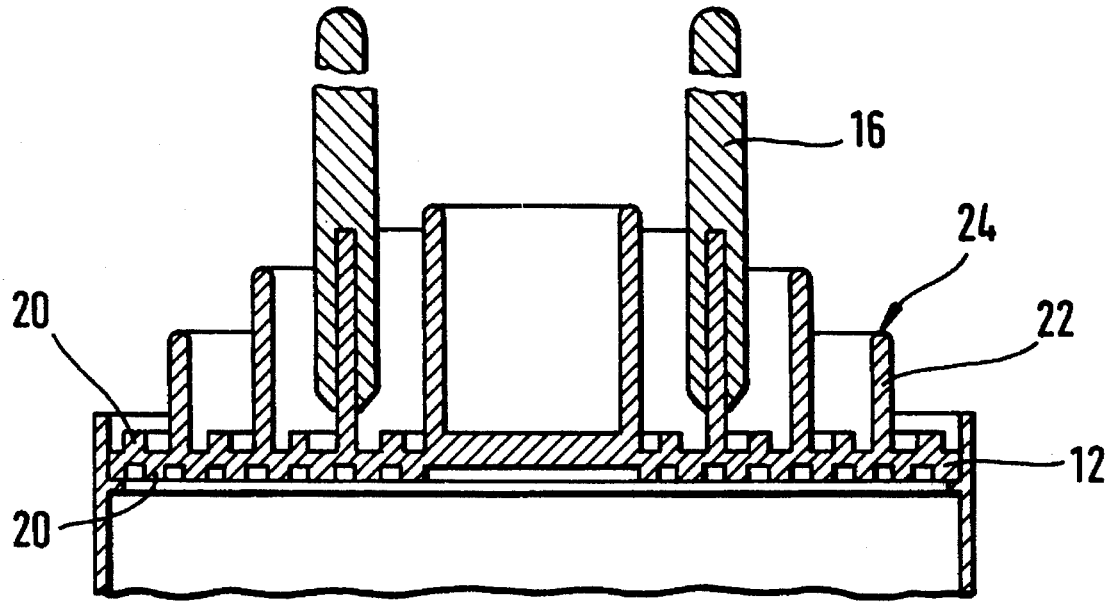
Fig. 4
Fig. 5
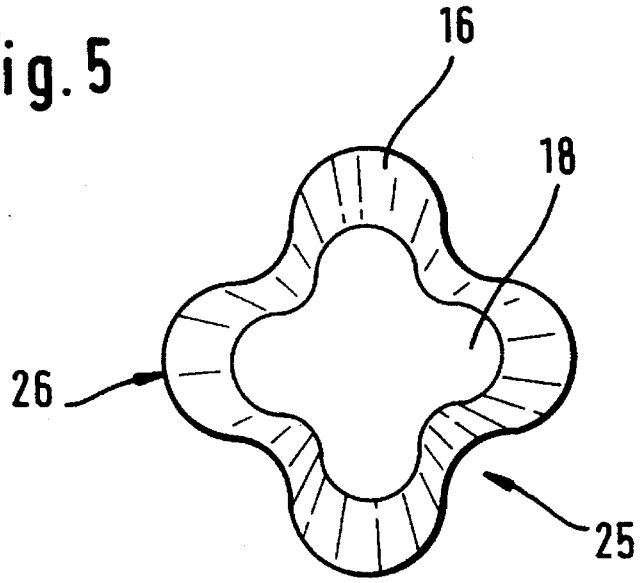

IMPLEMENT FOR STYLING/DRYING HAIR FOR AN AIR-MOVING APPLIANCE FOR PERSONAL USE

This invention relates to an implement for styling/drying hair for an air-moving appliance for personal use, in particular a hair dryer or a hot-air curling brush, comprising a body and a two-dimensional air discharge means which includes a series of air exit apertures and carries a series of hair pickup elements arranged adjacent to each other.

Such a hair styling implement is already known from printed specification GB 22 30 184 B. This implement is securable to a conventional hand-held hair dryer. The front face of the attachment includes a plurality of projecting prongs and air vent apertures. This device is intended to be suitable for untangling the hair as it is dried, for example. Because the prongs decrease in length radially outwardly from the center of the attachment, the user has difficulty in manipulating the device, and styling/drying of the hair is not conveniently accomplishable. In addition, only a small region of the hair can be picked up and styled/dried, making it a time-consuming and fatiguing task for its user.

By contrast, it is an object of the present invention to improve upon the known implement such as to improve the treatment of the hair and simplify the manipulation of the device for its user. This object is essentially accomplished in that downstream ends of the hair pickup elements lie on a substantially concave surface. When the implement mounted on the hair dryer is moved in the hair using light circular motions, the hair will be caught by the hair pickup elements, entering the space intermediate thereof. As a result of this movement, more hair will be caught and lifted in the direction of the air discharge means, causing the hair to be fluffed out in the space between the hair pickup elements. The exiting air will dry the hair in this position. As a result, the hair will be given a better stand in its root area. Greater fullness and body will be imparted to the hair. The circular motion of the hair pickup elements has an added massage effect, producing a pleasant feel on the scalp. Further, at least several hair pickup elements will engage the user's scalp in use of the implement, enabling a larger section of hair to be caught for styling/drying so that, overall, the duration of the styling/drying process is reduced.

Because those hair pickup elements that are arranged in an outer region, in particular an edge segment of the air discharge means, are of greater length than the hair pickup elements that are arranged in an inner region of the air discharge means, the ends of the hair pickup elements are disposed in an imaginary inclined plane, simplifying the manipulation of the implement still further. Arranging the fingers of different lengths in this manner enables the implement to cover also parts of the head which are otherwise hard to reach or the hair root area in the neck with ease, styling/drying the hair in these areas.

In an advantageous embodiment of the present invention, the concave surface is a portion of a spherical surface, the sphere diameter corresponding approximately to the mean diameter of a person's head. The surface being approximated to the shape of a person's head, substantially all hair pickup elements are in contact with the scalp in use of the implement. This enables a larger section of the hair to be styled and dried.

Advantageously, the air discharge means is of a convex configuration, enabling the hair to glide over the air discharge means as the device is used. This increases the hair's shine.

In an embodiment of the present invention, the hair pickup elements are arranged on concentric circular rings relatively spaced at approximately equal distances. This approximately uniform distribution of the hair pickup elements provides a sufficient distance between the hair pickup elements for catching individual strands of hair, in addition to ensuring an effective utilization of the surface of the air discharge means.

In an advantageous embodiment of the present invention, the hair pickup elements are arranged on the air discharge means in the form of two quadrangles disposed in a 90° offset relation to each other, their sides being curved in a concave fashion relative to a center of the air discharge means. Arranging the hair pickup elements in this manner is particularly advantageous when the implement is guided so as to engage within the hair close to the head from the side, as for dry combing and smoothing longer hair. The diameter of curvature of the sides is approximated to the mean diameter of a person's head, enabling all hair pickup elements on one side to be held close to the scalp and thus sufficiently large sections of hair to be caught.

Advantageously, the concave sides of the quadrangles correspond approximately to the arcs of a circle. As a result, a series of hair pickup elements will engage the hair also in cases where the hair styling/drying implement is held at an inclination, enabling even awkward-to-reach hair sections to be readily caught and styled by the implement.

Because the air discharge means is formed by circular rib members disposed in offset relation to each other in two planes, the exiting air will be swirled, slowing the airflow. This prevents the undesired effect of hair being upset as it is dried or styled.

Advantageously, the rib members are at least in part configured as annular walls of different heights, thereby adding to the uniformity of the exiting air stream and improving the styling and drying effect, particularly also the combing of the hair.

In an advantageous further feature, downstream end portions of the annular walls lie on a convex surface. As a result of this configuration, the hair is guided over these end portions as it is combed and/or smoothed, for example, utilizing a maximum surface and thus adding luster to the hair.

In a further embodiment of the present invention, the hair pickup elements are fixedly secured to the rib members. As a result, the air exiting intermediate the annular walls impinges directly on the hair that has entered the space between hair pickup elements, which has a beneficial effect on the styling and drying process.

According to an advantageous further feature of the present invention, the ratio of the length of the hair pickup elements to a mean diameter thereof is greater than about 5 to 1, preferably 8 to 1. This ratio is conducive to improving the desired effects including, for example, the obtainment of a better stand of the hair in the root area, particularly also where short hair is involved.

According to a still further feature of the present invention, the hair pickup elements are preferably of a star-shaped cross section with rounded edges. Shaping the hair pickup elements in this manner increases the number of edges engaging the hair, enabling a slight pull to be exerted on the hair and the smoothing effect to be improved, particularly where long hair is combed. In addition, this shape is advantageous from the injection-molding engineering point of view.

Further objects, features, advantages and application possibilities of the present invention will become apparent from the subsequent description of embodiments. It will be understood that all features described and/or represented by illustration, whether taken alone or in any desired combination, constitute the subject-matter of the present invention, irrespective of their summarization in the claims or their back-references.

In the drawings,

FIG. 4 is a schematic illustration, in section, of a second embodiment of the present invention; and FIG. 5 is an enlarged top plan view of a hair pickup element.

Figure 1:
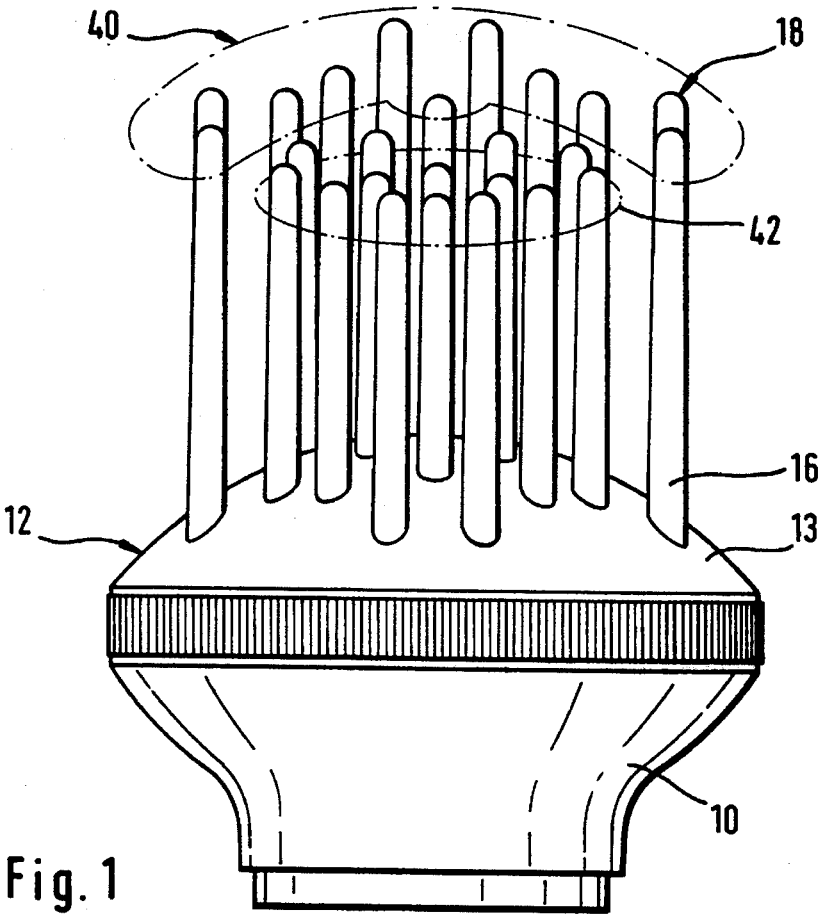
FIG. 1 is a front view of an implement illustrating a first embodiment of the present invention.
Figure 2:
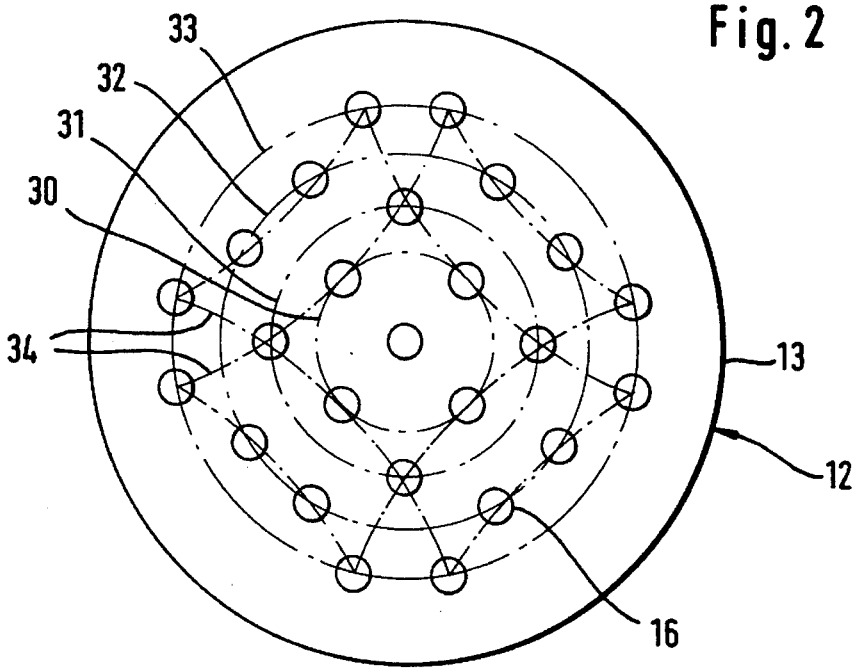
FIG. 2 is a top plan view of the implement of FIG. 1.

Referring now to FIG. 1 of the drawings, there is shown an implement for styling/drying hair, comprising a body 10 and an air discharge means 12 which are connected with each other. The air discharge means 12 includes a series of air exit apertures 14 and hair pickup elements 16 arranged adjacent to each other, the air exit apertures 14 being not shown in this Figure for clarity of illustration. The hair pickup elements 16 are of different lengths, terminating with their downstream ends 18 in a concave surface, that is, a surface curving inwardly relative to the air discharge means 12. This concave surface is a portion of a spherical surface, the sphere having a diameter corresponding approximately to the mean diameter of a person's head. It is thereby ensured that all hair pickup elements 16 of both the outer region 40 and the inner region 42 are in engagement with the scalp and that, when moving the hair dryer using an appropriate circular motion, the hair within the entire area bounded by the outer region 40 will be lifted up in the space between the hair pickup elements 16. The hair will be dried in this position, and a good stand of the hair in the root area will be accomplished. The hair will become softer and be made more voluminous. In addition to the fashioning and drying effect, the user will experience a very pleasant massage effect resulting from the engagement of all hair pickup elements 16 with the scalp and the use of a circular motion. For straightening out the hair or dry-combing longer hair, the hair styling/drying implement is held so as to engage in the hair from the side of the head, the longer length of the hair pickup elements 16 of the outer region 40 then enabling a sufficient section of hair to be caught and divided up into individual strands by the hair pickup elements 16. The strands of hair will be pulled over the convex, that is, outwardly curving, air discharge means 12 and dried as this occurs. An attendant advantage is that the hair will also be smoothed in the process. The gliding action of the hair over the surface of the air discharge means 12 adds luster to the hair. The implement may be used as an accessory for a hair dryer, or alternatively, it may form an integral part of the hair dryer. In either event, the user has the advantage of requiring only one hand for styling/drying, the need for an additional brush being obviated.

The hair pickup elements 16 are fixedly mounted on four equidistantly disposed concentric circular rings 30, 31, 32, and 33. In addition, they are arranged on the air discharge means 12 in the form of two quadrangles 34 disposed in a 90° offset relation to each other, their sides being curved in a concave fashion, with in particular individual ones of the hair pickup elements 16 being associable with either quadrangle 34.

The concave sides of the quadrangles 34 form lines corresponding approximately to the arcs of a circle. The arrangement of the hair pickup elements 16 is selected such that, when the implement is applied from the side for performing a combing operation, it will engage the hair close to the scalp, as a result of which all hair pickup elements 16 on a side will pick up hair. Through the air exit apertures 14 not shown for clarity of illustration, streams of air will be directed at the hair, drying it.

Figure 3:
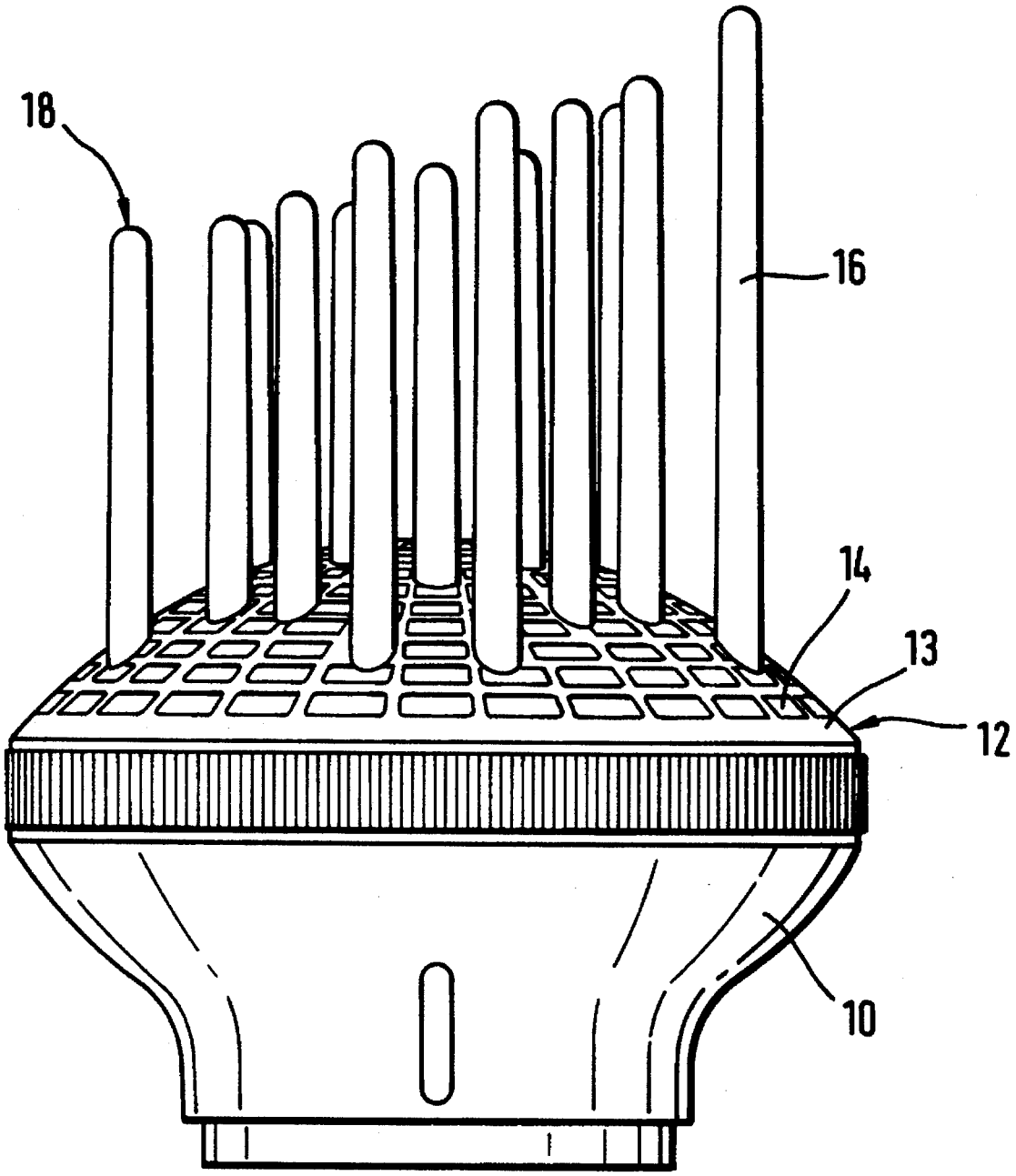
FIG. 3 is a side view of the implement of FIG. 1.

FIG. 3 shows a side view of the implement illustrating the different lengths of the hair pickup elements 16. The area of cross section 25 of the hair pickup elements 16 increases slightly starting from their downstream end 18 and continuing in the direction of the upstream end of the hair pickup elements 16 close to the air discharge means 12. In this configuration, the ratio of the length to a mean diameter of the hair pickup elements 16 is greater than 5 to 1 for the shortest one of the hair pickup elements. When a plane is applied to the ends 18 of the hair pickup elements 16, its angle of inclination relative to the front face of the hair dryer is between greater than 0° and about 30°, preferably 15°. By virtue of this inclination and the different lengths of the fingers, the user is in a position to manipulate a hair dryer to which the implement is attached with ease even in the head rear area, without the hair pickup elements 16 becoming disengaged from the scalp or the need to incline the hair dryer at an excessively sharp angle. In addition, the inclination assists the individual strands of hair in gliding up on the hair pickup elements 16. The air exit apertures 14 are approximately evenly distributed over the entire surface of the air discharge means 12.

FIG. 4 shows an air discharge means 12 which is of a plane configuration and formed by circular rib members 20. These are disposed in offset relation to each other in two planes, causing the air to be swirled whereby the velocity of flow of the exiting air is reduced. Part of these rib members 20 is in the form of annular walls 22. Downstream end portions 24 of the annular walls 22 lie on a convex surface relative to the surface of the air discharge means 12. Fixedly mounted on the rib members 20 are the hair pickup elements 16.

FIG. 5 shows a hair pickup element 16 which is of a quadrangular, preferably star-shaped cross section 25 with rounded edges 26. The diameter at the downstream end 18 of the hair pickup element 16 is slightly smaller than at the upstream end. In another configuration, the hair pickup elements may also be of a round cross section.

In a preferred embodiment, the air discharge means 12 of the implement has a diameter of about 93 mm and a radius of curvature of 60 mm. The length of the hair pickup elements 16 is between 40 mm and 70 mm, with a mean diameter of about 5 mm. The ratio of the length to the diameter of the hair pickup elements is thus between about 8 to 1 for the shortest, and about 14 to 1 for the longest, hair pickup element 16, with a total of preferably 25 hair pickup elements 16 being arranged on the air discharge means 12. The circular rings 30, 31, 32, and 33 on which the hair pickup elements 16 are disposed have a diameter of, respectively, 25 mm, 39 mm, 53 mm, and 67 mm. The ends 18 of the hair pickup elements 16 lie on a concave surface representing a portion of a spherical surface with a sphere diameter of about 210 mm. When the implement for styling/drying hair is placed on a section of hair and moved using a circular motion, this section of hair will be caught by the hair pickup elements 16 and lifted up by the hair picked up in succession, the hair winding along the hair pickup elements 16 in the process. The air discharged through the air exit apertures 14 will dry the strands of hair, providing them with a good stand in the root area and adding volume to the hair. When longer hair is combed dry, the hair will glide over the convex air discharge means 12. This hair gliding movement over the air discharge means 12 and its engagement with the hair pickup elements 16 will bring additional luster to the hair.

I claim:

1. An implement for styling hair for an air-moving appliance for personal use, said implement comprising a plurality of hair pickup elements, a body and an air discharge means which includes a plurality of air exit apertures and carries said plurality of hair pickup elements so that they are arranged adjacent relatively closely to each other, wherein said hair pickup elements have proximal ends and distal ends, said proximal ends being proximate to said air discharge means and said distal ends located in an outward direction from said air discharge means and said proximal ends, wherein said distal ends of the hair pickup elements intersect a substantially concave surface so as to abut, when in use, the head of a user, said substantially concave surface being concave relative to a location that is in said outward direction from said distal ends, wherein the hair pickup elements are of rod-shaped configuration, wherein said plurality of hair pickup elements are disposed on said air discharge means such that a first portion of said hair pickup elements is intersected by a single approximate arc of an approximate half circle and a second portion of said hair pickup elements is not intersected by said arc, and wherein the ratio of the length of the rod-shaped pickup elements to a mean diameter thereof is greater than 5 to 1.

2. An implement as claimed in claim 1 wherein the hair pickup elements are arranged in an inner region of the air discharge means and in an outer region of the air discharge means, and wherein the hair pickup elements arranged in the outer region are of greater length than the hair pickup elements arranged in the inner region.

3. An implement as claimed in claim 1 wherein the ratio is between 8 to 1 and 14 to 1.

4. An implement as claimed in claim 1 wherein the air discharge means is of a convex configuration, said convex configuration being convex relative to a location that is in an inward direction from said proximal ends.

5. An implement as claimed in claim 1 wherein the hair pickup elements are arranged in concentric circular rings and are relatively spaced at approximately equal distances.

6. An implement as claimed in claim 1 wherein the hair pickup elements are arranged on the air discharge means in the form of two quadrangles disposed in an 90° offset relation to each other, their sides being curved in a concave fashion relative to a center of the air discharge means.

7. An implement as claimed in claim 6 wherein the concave sides of the quadrangles correspond approximately to arcs of a circle.

8. An implement as claimed in claim 1 wherein the air discharge means is formed by circular rib members disposed in offset relation to each other in two planes.

9. An implement as claimed in claim 8 wherein the rib members are at least in part configured as annular walls of different heights.

10. An implement as claimed in claim 9, wherein downstream end portions of the annular walls lie on a convex surface, said convex surface being convex relative to a location that is in an inward direction from said proximal ends.

11. An implement as claimed in claim 8 wherein the hair pickup elements are fixedly secured to the rib members.

12. An implement as claimed in claim 1 wherein the air discharge means produces a main flow of air and wherein the hair pickup elements are arranged substantially in parallel with each other and in the direction of the main flow.

13. An implement as claimed in claim 1 wherein the hair pickup elements are of a star-shaped cross section with rounded edges.

14. An implement as claimed in claim 1 wherein the hair pickup elements are of a circular cross-section.

15. An implement as claimed in claim 1, wherein the distal ends of the hair pickup elements are rounded off.

16. An implement as claimed in claim 1, wherein said air discharge means has a circular basal surface.

17. An implement as claimed in claim 1, wherein the air discharge means produces a main flow of air and wherein the distal ends of an outer perimeter of the hair pickup elements lie in an imaginary plane that is inclined with respect to the direction of the main flow.

18. An implement as claimed in claim 1, wherein when a user places the implement with the distal ends of the hair pickup elements on the user's head and moves it in the hair, some of the hair is caught by the hair pickup elements, lifted up between the hair pickup elements in the direction of the air discharge means, and dried in this position, providing the hair with a good stand in the root area and adding volume to the hair.

19. An implement as claimed in claim 1, wherein the hair pickup elements are longer than 25 mm.

20. An implement as claimed in claim 19, wherein the hair pickup elements are longer than 40 mm.

21. An implement as claimed in claim 19, wherein the hair pickup elements are between 40 and 70 mm in length.

22. An implement as claimed in claim 1, wherein the hair pickup elements have a mean diameter of about 5 mm.

23. An implement as claimed in claim 22, wherein the hair pickup elements are between 25 and 70 mm in length and have a mean diameter of about 5 mm.

24. An implement as claimed in claim 23 wherein the hair pickup elements are of a star-shaped cross section with rounded edges.

25. An implement as claimed in claim 1 wherein a proximal end cross sectional area of a said hair pickup element is greater than a distal end cross sectional area of the said hair pickup element.

26. An implement as claimed in claim 1 wherein said substantially concave surface is symmetric about an imaginary plane of symmetry of said plurality of hair pickup elements, said plane of symmetry extending parallel to said hair pickup elements.

27. An implement for styling hair for an air-moving appliance for personal use, said implement comprising a plurality of hair pickup elements, a body and an air discharge means which includes a plurality of air exit apertures and carries said plurality of hair pickup elements so that they are arranged adjacent relatively closely and substantially in parallel to each other, wherein said hair pickup elements have a longitudinal axis connecting proximal ends and distal ends, said proximal ends being proximate to said air discharge means and said distal ends located in an outward direction from said air discharge means and said proximal ends, wherein said distal ends of the hair pickup elements intersect a substantially inclined planar surface so as to abut, when in use, the head of a user, said substantially inclined planar surface being inclined relative to said longitudinal axis, wherein the hair pickup elements are of rod-shaped configuration, and wherein the ratio of the length of the rod-shaped pickup elements to a mean diameter thereof is greater than 5 to 1.

28. An implement as claimed in claim 27 wherein the hair pickup elements are arranged in an inner region of the air discharge means and in an outer region of the air discharge means, and wherein the hair pickup elements arranged in the outer region are of greater length than the hair pickup elements arranged in the inner region.

29. An implement as claimed in claim 27 wherein the ratio is between 8 to 1 and 14 to 1.

30. An implement as claimed in claim 27 wherein the air discharge means is of a convex configuration, said convex configuration being convex relative to a location that is in an inward direction from said proximal ends.

31. An implement as claimed in claim 27 wherein the hair pickup elements are arranged in concentric circular rings and are relatively spaced at approximately equal distances.

32. An implement as claimed in claim 27 wherein the hair pickup elements are arranged on the air discharge means in the form of two quadrangles disposed in an 90° offset relation to each other, their sides being curved in a concave fashion relative to a center of the air discharge means.

33. An implement as claimed in claim 32 wherein the concave sides of the quadrangles correspond approximately to arcs of a circle.

34. An implement as claimed in claim 27 wherein the air discharge means is formed by circular rib members disposed in offset relation to each other in two planes.

35. An implement as claimed in claim 34 wherein the rib members are at least in part configured as annular walls of different heights.

36. An implement as claimed in claim 35, wherein downstream end portions of the annular walls lie on a convex surface, said convex surface being convex relative to a location that is in an inward direction from said proximal ends.

37. An implement as claimed in claim 34 wherein the hair pickup elements are fixedly secured to the rib members.

38. An implement as claimed in claim 27 wherein the air discharge means produces a main flow of air and wherein the hair pickup elements are arranged substantially in the direction of the main flow.

39. An implement as claimed in claim 27 wherein the hair pickup elements are of a star-shaped cross section with rounded edges.

40. An implement as claimed in claim 27 wherein the hair pickup elements are of a circular cross-section.

41. An implement as claimed in claim 27, wherein the distal ends of the hair pickup elements are rounded off.

42. An implement as claimed in claim 27 wherein said air discharge means has a circular basal surface.

43. An implement as claimed in claim 27, wherein the air discharge means produces a main flow of air and wherein said substantially inclined planar surface is inclined with respect to the direction of the main flow.

44. An implement as claimed in claim 27, wherein when a user places the implement with the distal ends of the hair pickup elements on the user's head and moves it in the hair, some of the hair is caught by the hair pickup elements, lifted up between the hair pickup elements in the direction of the air discharge means, and dried in this position, providing the hair with a good stand in the root area and adding volume to the hair.

45. An implement as claimed in claim 27 wherein the hair pickup elements are longer than 25 mm.

46. An implement as claimed in claim 45 wherein the hair pickup elements are longer than 40 mm.

47. An implement as claimed in claim 45 wherein the hair pickup elements are between 40 and 70 mm in length.

48. An implement as claimed in claim 27 wherein the hair pickup elements have a mean diameter of about 5 mm.

49. An implement as claimed in claim 48 wherein the hair pickup elements are between 25 and 70 mm in length and have a mean diameter of about 5 mm.

50. An implement as claimed in claim 49 wherein the hair pickup elements are of a star-shaped cross section with rounded edges.

51. An implement as claimed in claim 27 wherein a proximal end cross sectional area of a said hair pickup element is greater than a distal end cross sectional area of the said hair pickup element.

52. An implement as claimed in claim 27 wherein said substantially inclined planar surface is symmetric about an imaginary plane of symmetry of said plurality of hair pickup elements, said plane of symmetry extending parallel to said hair pickup elements.

53. An implement as claimed in claim 27 wherein said substantially inclined planar surface is inclined between about 60° and less than 90° relative to said longitudinal axis.

54. An implement as claimed in claim 27 wherein said substantially inclined planar surface is inclined about 75° relative to said longitudinal axis.

55. An implement for styling hair for an air-moving appliance for personal use, said implement comprising a plurality of hair pickup elements, a body and an air discharge means which includes a plurality of air exit apertures and carries said plurality of hair pickup elements so that they are arranged adjacent relatively closely to each other, wherein said hair pickup elements have proximal ends and distal ends, said proximal ends being proximate to said air discharge means and said distal ends located in an outward direction from said air discharge means and said proximal ends, wherein said distal ends of the hair pickup elements intersect a substantially concave surface so as to abut, when in use, the head of a user, said substantially concave surface being concave relative to a location that is in said outward direction from said distal ends, wherein the hair pickup elements are of rod-shaped configuration, wherein each said hair pickup element is adjacent at least three other said hair pickup elements, and wherein the ratio of the length of the rod-shaped pickup elements to a mean diameter thereof is greater than 5 to 1.

56. An implement as claimed in claim 55 wherein the hair pickup elements are arranged in an inner region of the air discharge means and in an outer region of the air discharge means, and wherein the hair pickup elements arranged in the outer region are of greater length than the hair pickup elements arranged in the inner region.

57. An implement as claimed in claim 55 wherein the ratio is between 8 to 1 and 14 to 1.

58. An implement as claimed in claim 55 wherein the air discharge means is of a convex configuration, said convex configuration being convex relative to a location that is in an inward direction from said proximal ends.

59. An implement as claimed in claim 55 wherein the hair pickup elements are arranged in concentric circular rings and are relatively spaced at approximately equal distances.

60. An implement as claimed in claim 55 wherein the hair pickup elements are arranged on the air discharge means in the form of two quadrangles disposed in an 90° offset relation to each other, their sides being curved in a concave fashion relative to a center of the air discharge means.

61. An implement as claimed in claim 60 wherein the concave sides of the quadrangles correspond approximately to arcs of a circle.

62. An implement as claimed in claim 55 wherein the air discharge means is formed by circular rib members disposed in offset relation to each other in two planes.

63. An implement as claimed in claim 62 wherein the rib members are at least in part configured as annular walls of different heights.

64. An implement as claimed in claim 63, wherein downstream end portions of the annular walls lie on a convex surface, said convex surface being convex relative to a location that is in an inward direction from said proximal ends.

65. An implement as claimed in claim 62 wherein the hair pickup elements are fixedly secured to the rib members.

66. An implement as claimed in claim 55 wherein the air discharge means produces a main flow of air and wherein the hair pickup elements are arranged substantially in parallel with each other and in the direction of the main flow.

67. An implement as claimed in claim 55 wherein the hair pickup elements are of a star-shaped cross section with rounded edges.

68. An implement as claimed in claim 55 wherein the hair pickup elements are of a circular cross-section.

69. An implement as claimed in claim 55, wherein the distal ends of the hair pickup elements are rounded off.

70. An implement as claimed in claim 55 wherein said air discharge means has a circular basal surface.

71. An implement as claimed in claim 55, wherein the air discharge means produces a main flow of air and wherein the distal ends of an outer perimeter of the hair pickup elements lie in an imaginary plane that is inclined with respect to the direction of the main flow.

72. An implement as claimed in claim 55, wherein when a user places the implement with the distal ends of the hair pickup elements on the user's head and moves it in the hair, some of the hair is caught by the hair pickup elements, lifted up between the hair pickup elements in the direction of the air discharge means, and dried in this position, providing the hair with a good stand in the root area and adding volume to the hair.

73. An implement as claimed in claim 55 wherein the hair pickup elements are longer than 25 mm.

74. An implement as claimed in claim 73 wherein the hair pickup elements are longer than 40 mm.

75. An implement as claimed in claim 73 wherein the hair pickup elements are between 40 and 70 mm in length.

76. An implement as claimed in claim 55 wherein the hair pickup elements have a mean diameter of about 5 mm.

77. An implement as claimed in claim 76 wherein the hair pickup elements are between 25 and 70 mm in length and have a mean diameter of about 5 mm.

78. An implement as claimed in claim 77 wherein the hair pickup elements are of a star-shaped cross section with rounded edges.

79. An implement as claimed in claim 55 wherein a proximal end cross sectional area of a said hair pickup element is greater than a distal end cross sectional area of the said hair pickup element.

80. An implement as claimed in claim 55 wherein said substantially concave surface is symmetric about an imaginary plane of symmetry of said plurality of hair pickup elements, said plane of symmetry extending parallel to said hair pickup elements.

81. The implement of claim 1 in combination with an air-moving appliance for personal use.

82. The implement of claim 27 in combination with an air-moving appliance for personal use.

83. The implement of claim 55 in combination with an air-moving appliance for personal use.

* * * * *